United States Patent [19]

Ishizuka et al.

[11] Patent Number: 4,765,249

[45] Date of Patent: Aug. 23, 1988

[54] GANGWAY CONSTRUCTION FOR VEHICLES

[75] Inventors: Masashi Ishizuka, Kobe; Rokuro Ando, Nagoya; Mikio Hatano, Kasugai; Koji Tabata, Nagoya, all of Japan

[73] Assignees: Narita Seisakusho Mfg., Ltd.; Kawasaki Jukogyo Kabushiki Kaisha, both of Japan

[21] Appl. No.: 870,985

[22] Filed: Jun. 5, 1986

[30] Foreign Application Priority Data

Jun. 19, 1985 [JP] Japan ..... 60-135010

[51] Int. Cl.[4] ..... B60D 5/00

[52] U.S. Cl. ..... 105/10; 105/17; 105/21

[58] Field of Search ..... 105/10, 11, 8.1, 21, 105/15, 16, 17, 18, 12

[56] References Cited

U.S. PATENT DOCUMENTS

| | | | |
|---|---|---|---|
| 417,567 | 12/1889 | Krehbiel | 105/21 X |
| 440,615 | 11/1890 | Bates | 105/10 |
| 443,075 | 12/1890 | Elliott | 105/21 X |
| 474,966 | 5/1892 | McElroy | 105/10 |
| 946,875 | 1/1910 | Krakau | 105/17 |
| 2,337,081 | 12/1943 | Blomberg | 105/15 |
| 2,645,517 | 7/1953 | Reverberi | 105/15 X |
| 2,931,317 | 4/1960 | Hunt | 105/10 |
| 3,712,244 | 1/1973 | Vollenweider | 105/21 |
| 3,754,515 | 8/1973 | Van Der Sluys et al. . | |
| 4,252,065 | 2/1981 | Bickel et al. . | |
| 4,411,201 | 10/1983 | Hassel et al. | 105/15 X |

FOREIGN PATENT DOCUMENTS

| | | | |
|---|---|---|---|
| 293697 | 8/1916 | Fed. Rep. of Germany | 105/12 |
| 2492758 | 4/1982 | France | 105/8.1 |
| 59-41426 | 10/1984 | Japan . | |
| 524497 | 8/1972 | Switzerland . | |
| 374802 | 6/1932 | United Kingdom . | |
| 810734 | 3/1959 | United Kingdom . | |
| 998189 | 2/1983 | U.S.S.R. | 105/10 |
| 1000324 | 3/1983 | U.S.S.R. | 105/10 |

*Primary Examiner*—Peter A. Aschenbrenner
*Assistant Examiner*—Thomas A. Rendos
*Attorney, Agent, or Firm*—Leydig, Voit & Mayer

[57] ABSTRACT

A gangway construction for vehicles comprises divided hood structures each of which has a first end and second end, the first ends of the respective hood structures being fixed to the vehicles, and the second ends thereof being made free and to face each other, a plurality of hood pressers provided between upper sides of metal frames on a free side of the hood structure and the vehicles and between lower sides thereof and the vehicles for urging the hood structures in their extension direction upon coupling operation, the plurality of hood pressers being arranged in a horizontal plane in convergent relation, and positioning members for guiding and engaging each other upon mutual approach of the members to effect a centering action, the positioning members being provided in the release side metal frames.

7 Claims, 12 Drawing Sheets

GANGWAY CONSTRUCTION FOR VEHICLES

BACKGROUND OF THE INVENTION

The present invention relates to a gangway construction for vehicles.

As in examples shown in Japanese Patent Publication No. 41426/84, most of conventional gangway constructions for vehicles or railway cars are made so that upper portions of two-divided units are coupled to each other by hinge means or fastening means provided around the two-divided units.

In the conventional constructions, it is necessary to manually carry out an insertion or removal of pins of the hinge means or a fastening or disconnecting of the fastening means for the two-divided units, upon the connecting or disconnecting operation of the vehicles. Thus there is a problem such that it is impossible to automate the connecting and disconnecting operations.

SUMMARY OF THE INVENTION

Accordingly, an object of the present invention is to provide a gangway construction for vehicles, which is capable of automatically and positively carrying out connecting and disconnecting operations of divided hood structures not only on straight railways but also on curved railways, without any manual works.

According to the present invention, a gangway construction for vehicles comprises divided hood structures each of which has a first end and a second end, the first ends of the respective hood structures being fixed to the vehicles, and the second ends thereof being made to face each other, a plurality of hood pressers provided between upper sides of metal frames on the release side and the vehicles and between lower sides thereof and the vehicles for urging the hood structures into their extended positions upon coupling operation, the plurality of hood pressers being arranged in horizontal planes to converge with each other, and positioning members for guiding and engaging each other upon the mutual approach to effect a centering action, the positioning members being provided in the metal frames of the free sides of the divided hood structures.

With such a gangway construction for vehicles, when the vehicles to be coupled to each other are made to approach each other, a centering operation is automatically carried out by the positioning members provided to the respective free side metal frames of the hood structures even though the free side metal frames are displaced relative to each other. When the vehicles are made to further approach, the free side metal frames are brought into contact with each other. When the vehicles are made to further approach to be coupled to each other, the free side metal frames are coupled against spring forces of the hood pressers. Therefore, under this coupled state, the free side metal frames of the two hood structures are kept in pressing contact by the spring forces of the hood pressers. At the same time, by the engagement of the positioning members, the hood structures are kept connected relative to each other in the widthwise direction of the vehicles without any relative shift. Also, the arrangement of the hood pressers in convergent relation makes it possible to always urge the hood structures toward the centerline of the vehicles. Also, by separating the couplers to separate the vehicles, the hood structures are automatically separated while being held at the vehicles, since the hood structures are connected in pressing contact by the hood pressers.

DESCRIPTION OF THE PREFERRED EMBODIMENTS

The preferred embodiments of the invention will now be described with reference to the accompanying drawings.

Figure 1:
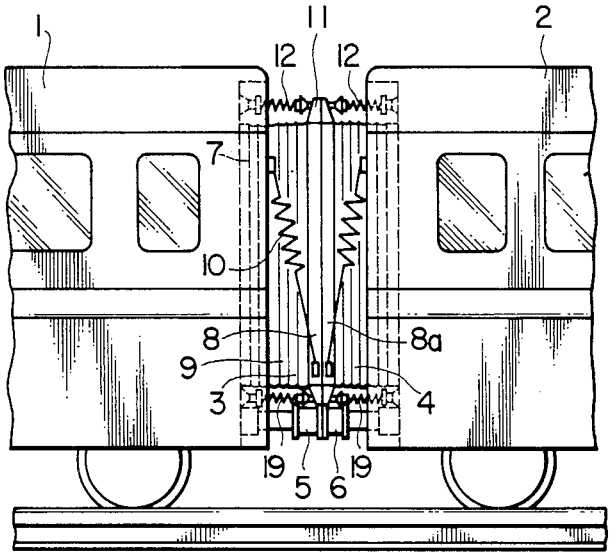
FIG. 1 is a side elevational view showing one embodiment of the invention.

Referring now to FIG. 1, hood structures 3 and 4 divided into two sections in a longitudinal direction are associated with two railway cars or vehicles 1 and 2 to be connected each other. The railway cars 1, 2 are provided with opening portions, facing each other. A vehicle side metal frame of each of the hood structures 3 and 4 is fixed to the opening portion of the associated vehicle. The two vehicles 1 and 2 may be separated from each other by disconnecting couplers 5 and 6 so that the hood structures 3 and 4 may be separated from each other along central dividing and facing portions. Also, the couplers 5 and 6 may be connected to each other so that the facing portions of the hood structures 3 and 4 may be pressingly connected to each other. Thus, a gangway portion between the two vehicles is defined and covered by the two hood structures 3 and 4.

Since the two hood structures 3 and 4 have the same construction, one of the hood structures 3 will be explained in detail with reference to FIG. 2. A stationary metal frame 7 of the hood structure 3 is formed in an annular shape to define the gangway and is fixed at a first end to the opening portion of the vehicle 1 by bolts or any other fastening means. Also, a free side metal frame 8 at a second end of the hood structure 3 is formed in an annular shape to define the gangway in cooperation with the stationary metal frame 7. A hood member 9 which is in the form of a bellows extendable as desired is laid between the free side metal frame 8 and the stationary metal frame 7. The free side metal frame 8 is suspended by metal frame suspenders 10 such as coil springs or the like laid between both sides of the metal frame and the opening portion of the vehicle.

Figure 3:
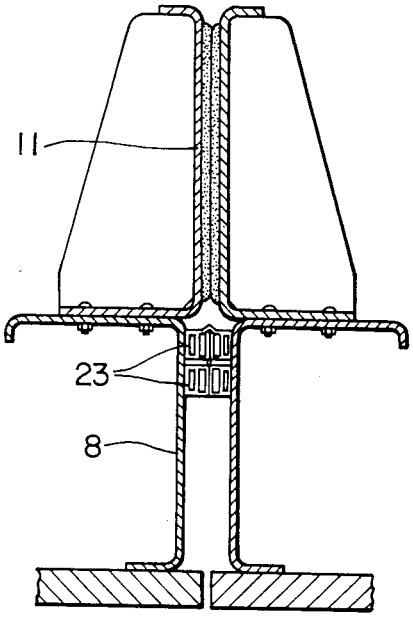
FIG. 3 is an enlarged cross-sectional view showing an upper portion of the free side metal frame of the hood structure shown in FIG. 2.

An upper support plate 11 is provided on a top of the free side metal frame 8. The detail thereof is shown in FIG. 3.

Figure 2:
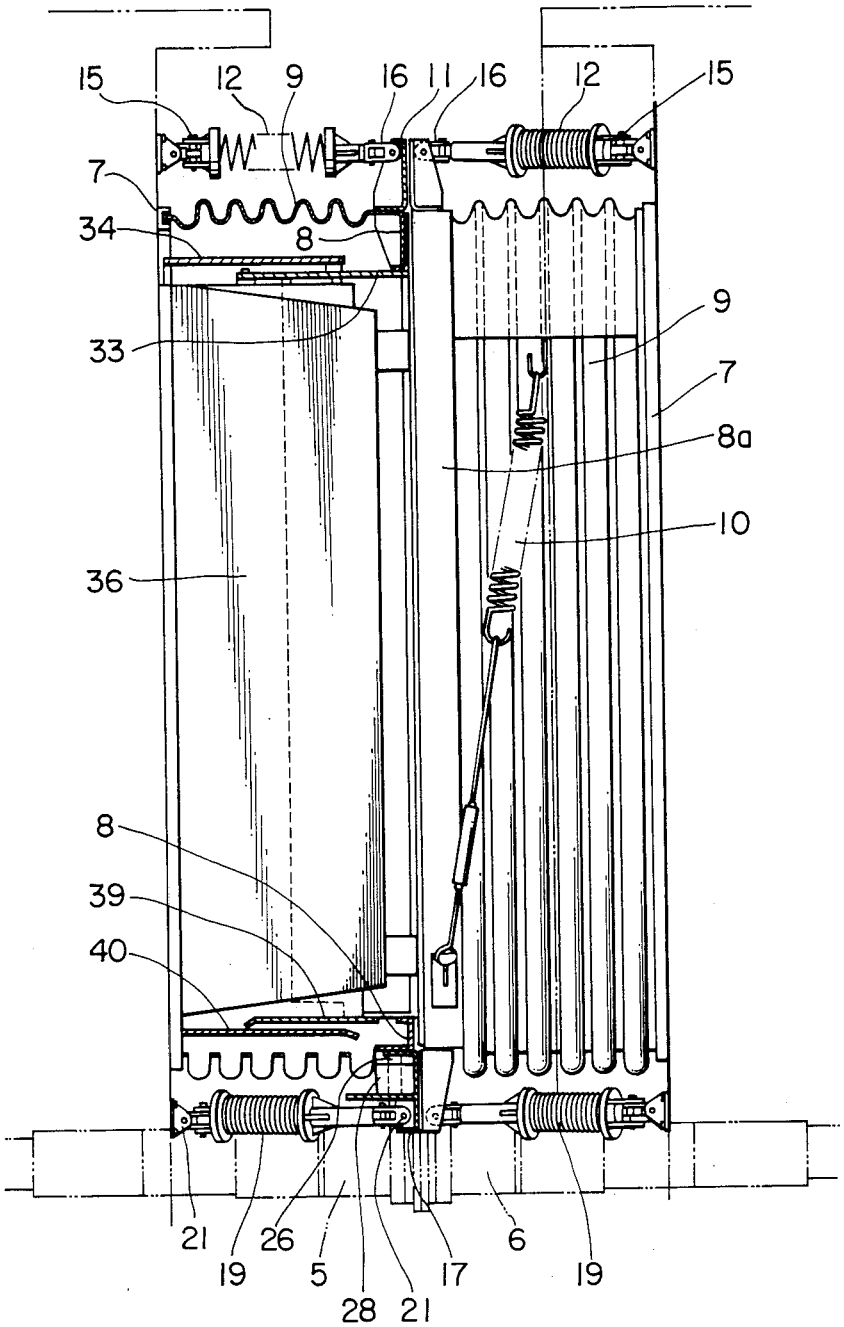
FIG. 2 is an enlarged view showing a gangway construction for vehicles shown in FIG. 1, a left half of FIG. 2 being an elevational cross-section and a right half of FIG. 2 being a side elevation.
Figure 4:
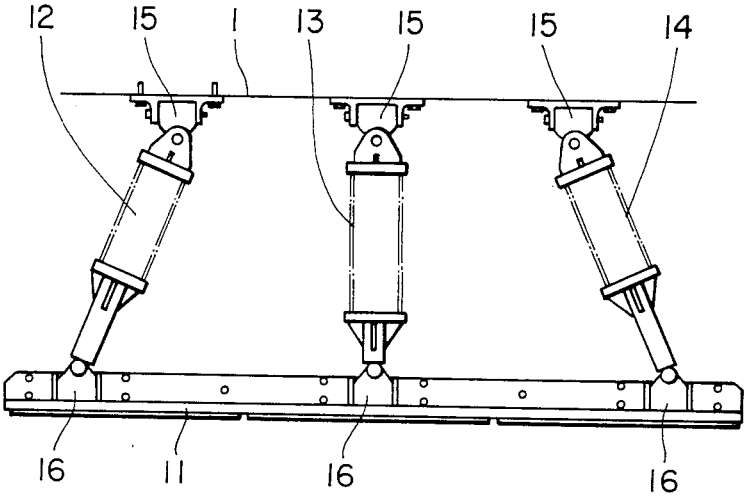
FIG. 4 is an enlarged plan view showing hood pressers located above the upper portion of the hood structure shown in FIG. 2.

As shown in FIGS. 2 and 4, a plurality (three in the embodiment) of hood pressers 12, 13 and 14 are arranged in a horizontal plane in convergent relation between the upper support plate 11 and the vehicle 1. Each of the hood pressers 12, 13 and 14 has a coil spring provided around a shaft unit made up of an extendable cylinder and piston so as to be normally extended and be contractable when it is compressed. Mount members 15 and 16 each of which is made up of a universal joint are provided at opposite ends of each hood pressers, whereby the opening portion of the vehicle 1 is coupled to the upper support plate 11 of the free side metal frame 8.

The central hood presser 13 is arranged in alignment with a centerline of the vehicle 1, whereas the both side hood pressers 12 and 14 are arranged in a convergent manner so that the pressers 12 and 14 are inclined in a direction opposite to each other with respect to the centerline of the vehicle 1. A pressing action of partial component of force exerted in the transverse direction of the vehicle by the both side hood pressers 12 and 14 causes the free side metal frame 8 to be urged to be returned back to the central position of the gangway in the case where the center of the free side metal frame 8 is displaced from the centerline of the gangway in the widthwise direction.

Figure 5:
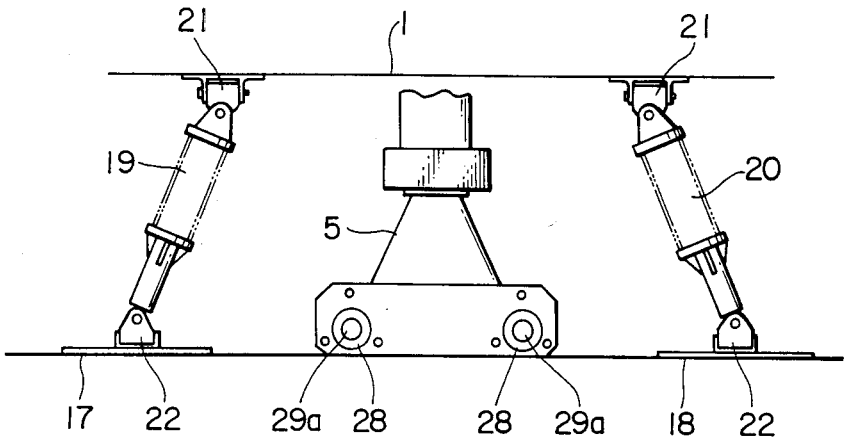
FIG. 5 is an enlarged plan view showing lower hood pressers below the hood structure shown in FIG. 2.
Figure 6:
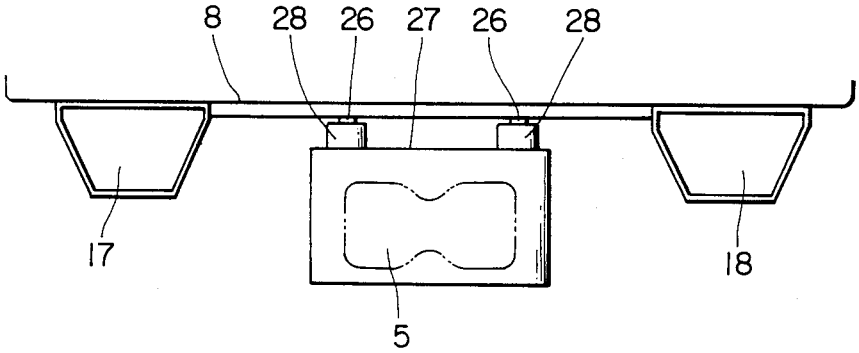
FIG. 6 is an enlarged frontal view showing a state of the lower support of the free side metal frame shown in FIG. 2.

As shown in FIG. 6, two bottom support plates 17 and 18 positioned at both sides of the coupler 5 are provided at a bottom of the free side metal frame 8. As shown in FIGS. 2 and 5, a plurality (two in the embodiment) of hood pressers 19 and 20 are arranged in a horizontal plane in convergent relation between the bottom support plates 17 and 18 and the vehicle 1 and are located on both sides of the coupler 5. The hood pressers 19 and 20 have the same structure as that of the above-described hood pressers 12, 13 and 14. Namely, the hood pressers 19 and 20 are coupled between the opening portion of the vehicle 1 and the bottom support plates 17 and 18 of the free side metal frame 8 by means of mount members 21 and 22 such as universal joints. Also, the two hood pressers 19 and 20 are arranged in a plane in a convergently inclined manner so as to have the same function as that of the convergently inclined hood pressers 12 and 14. The pressing forces of the respective hood pressers 12, 13, 14, 19 and 20 are selected so that, when the vehicles are coupled to each other, the free side metal frames 8 and 8*a* of the confronting hood structures 3 and 4 press against each other at a desired pressure.

Figure 7:
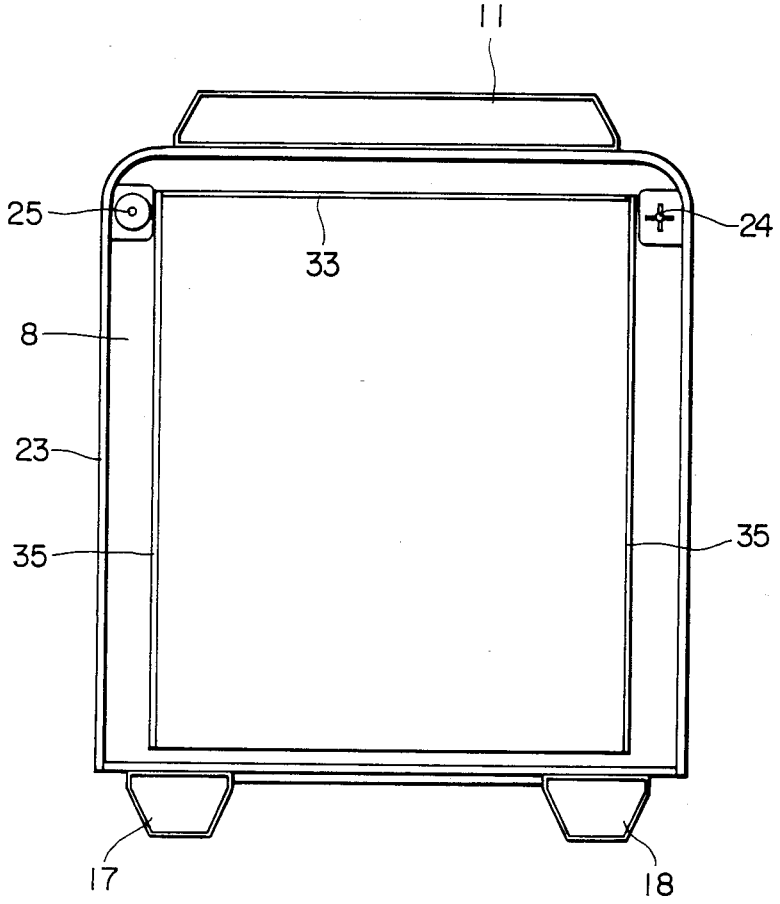
FIG. 7 is a front elevational view of one free side metal frame provided with the positioning hole and projection.
Figure 10:
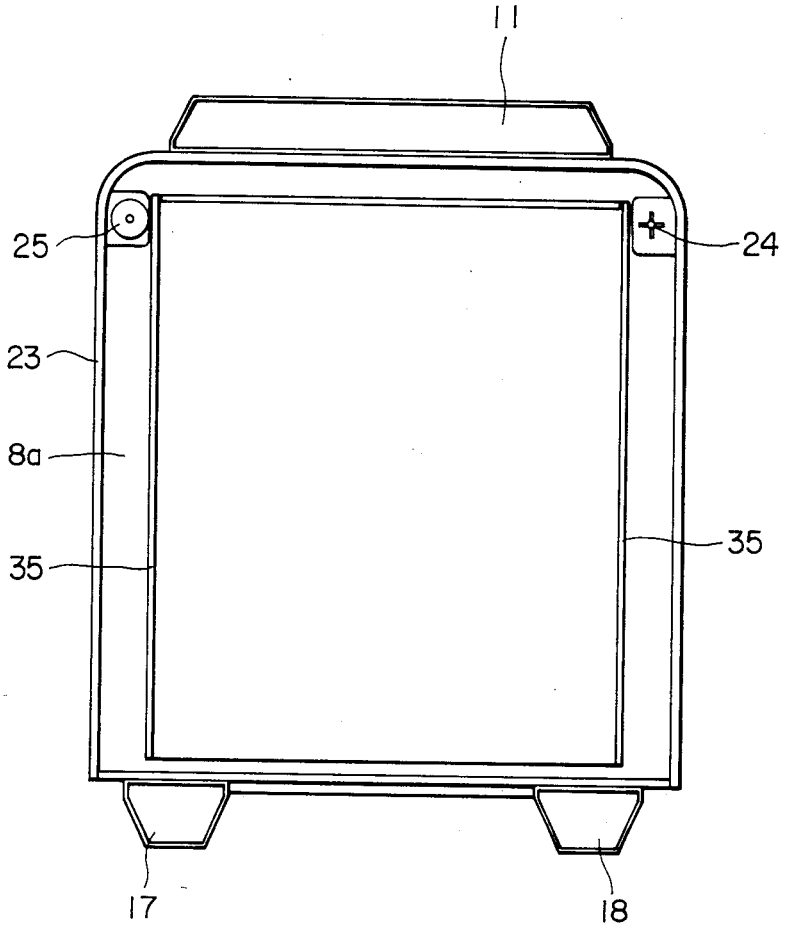
FIG. 10 is a front elevational view of the other free side metal frame provided with the positioning hole and projection.
Figure 11:
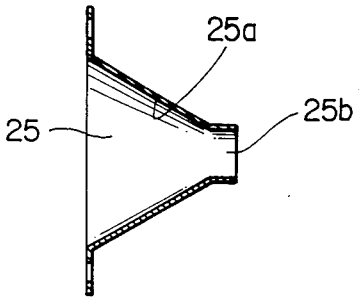
FIG. 11 is a side view showing the positioning hole shown in FIGS. 7 and 10.
Figure 12:
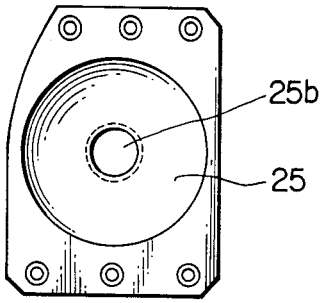
FIG. 12 is a front view showing the positioning hole shown in FIG. 11.

A seal member 23 made of elastic material for preventing rain drops from entering into the interior is provided over an entire circumference of a front face of free side metal frame 8, 8*a* of each hood structure 3, 4, as shown in FIGS. 7 and 10. The pressing contact between the hood structures 3 and 4 causes the seal members 23, 23 to be held in intimate contact with each other to seal the interior of the gangway from the outside.

Figure 8:
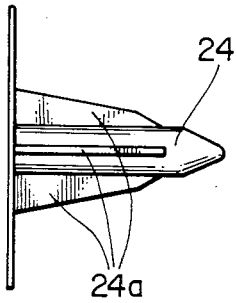
FIG. 8 is an enlarged side view showing the projection shown in FIG. 7.
Figure 9:
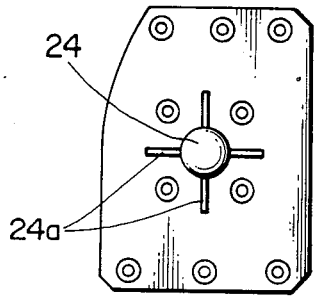
FIG. 9 is a front elevational view of the positioning projection shown in FIG. 8.

Furthermore, as shown in FIG. 7, to the front face of the free side metal frame 8, there is fixedly provided a positioning projection 24 projected forwardly from an upper corner portion of the frame 8. Fixed to the positioning projection 24 are tapered vanes 24*a* whose proximal end portions are widened as shown in FIGS. 8 and 9.

In the release side metal frame 8*a* of the hood structure 4 confronting projection 24, an associated positioning hole 25 to be engaged with the positioning projection 24 is formed at a position in alignment with the positioning projection 24.

The positioning hole 25 is made up of a cone-shaped guide portion 25*a* for guiding the introduction of the positioning projection 24 and an engagement hole portion 25*b*. In the same manner, another positioning hole 25 is formed in the release side metal frame 8 whereas a like positioning projection 24 is provided on the release side metal frame 8*a*.

As shown in FIG. 6, at the undersurface of the free side metal frame 8, there are securely formed right and left pins 26, 26 located at the top portions of the coupler 5 and extending downwardly. As shown in FIGS. 5 and 6, on the top surface of the coupler 5, there is fixedly provided a mount plate 27 to which pin receivers 28, 28 to be engaged with the above-described pins 26, 26 are arranged in alignment with the pins 26, 26.

Figure 13:
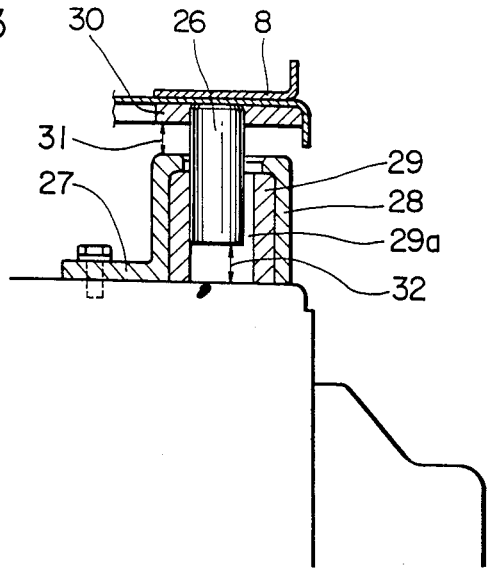
FIG. 13 is an enlarged cross-sectional view showing a pin and pin receiver shown in FIG. 6.

Details of the pins 26 and the pin receivers 28 will be described with reference to FIG. 13. Each pin 26 is loosely engaged with a hole 29*a* of a cylindrical bushing 29 made of, for example, resin and fixed within each receiver 28. An inner diameter of the hole 29*a* is somewhat greater than an outer diameter of the pin 26. In the normal condition, a clearance or gap 31 is defined between a base plate 30 of the pin 26 and the top surface of the pin receiver 28. An up-and-down length of the clearance 31 is shorter than that of a clearance or gap 32 at the lower end of the pin 26.

Figure 14:
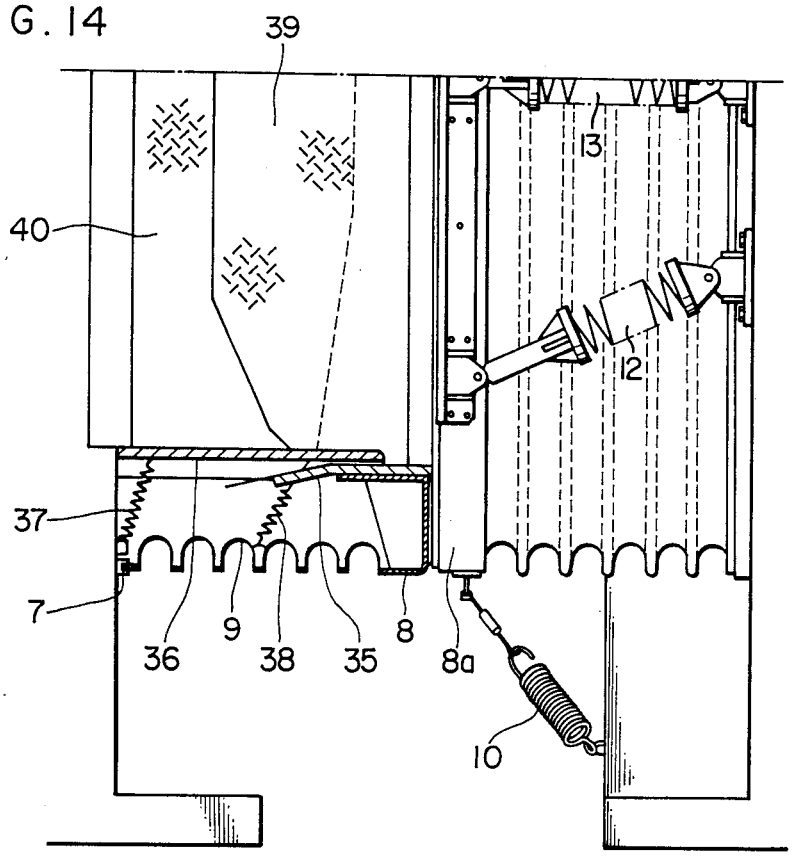
FIG. 14 is a view showing the gangway construction for vehicles shown in FIG. 1, a left half of FIG. 14 being a partial cross-sectional plan view and a right half of FIG. 14 is a plan view.

In the ceiling which defines the gangway within the hood structure 3, as shown in FIG. 2, two ceiling panels 33 and 34 are provided with a front edge of the forward ceiling panel 33 fixed to the free side metal frame 8 and a rear edge of the rear ceiling panel 34 supported to the vehicle 1. The front portion of rear ceiling panel 34 is slidably laid on the top surface of the forward ceiling panel 33. As shown in FIG. 14, two side panels 35 and 36 are provided on each side of the gangway with a front edge of the forward side panel 35 fixed to the free side metal frame 8 and a rear edge of the rear side panel 36 supported to the vehicle 1 rotatably in a plane.

A front portion of the rear side panel 36 is held in sliding contact with the inner surface of the front side panel 35, whereas the rear side panel 36 is urged in the contact direction by a spring 37. The hood member 9 is suspended from the front side panel 36 by a suspender 38.

As shown in FIG. 2, two bridge plates 39 and 40 are provided at the bottom of the gangway. The front edge of the front bridge plate 39 is connected pivotably about the release side metal frame 8 to be allowed to rise but normally on, to be in contact with the top surface of the rear bridge plate 40 as shown. Also, the rear edge of the rear bridge plate 40 is similarly pivotably connected about the body 1 end to be allowed to rise.

The operation of the embodiment of the invention will now be described.

Figure 15:
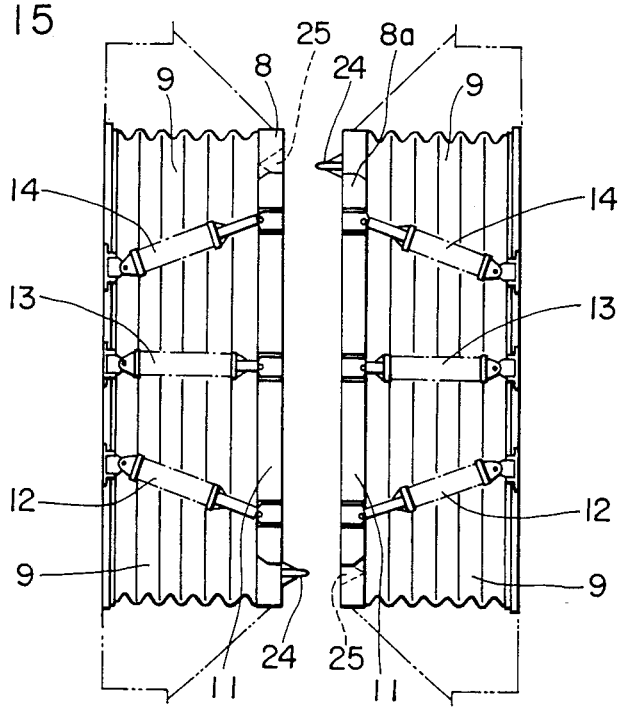
FIG. 15 is a plan view showing a separated state of the hood structure.
Figure 16:
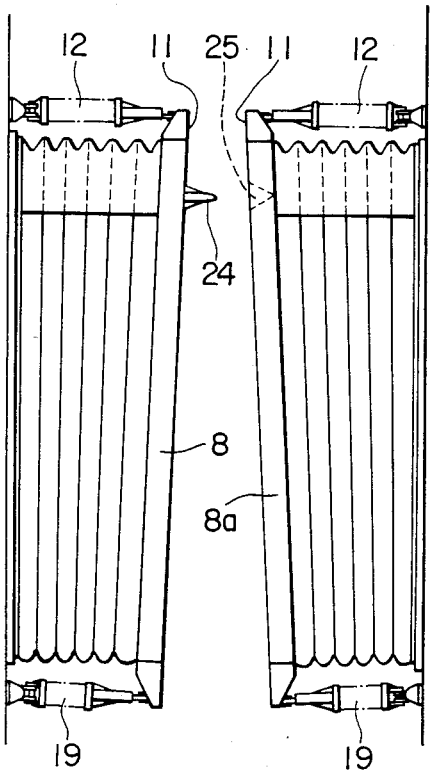
FIG. 16 is a side elevational view showing the separated state.

FIGS. 15 and 16 show a state in which the couplers 5 and 6 are disconnected from each other to thereby separate the vehicles 1 and 2. Under this state, the hood structures 3 and 4 are separated from each other and at the same time the upper portions thereof are extended by the spring force of the hood pressers 12, 13 and 14 whereas the bottom portions are restricted by the couplings between the pins 26 and the pin receivers 28. Thus, the upper portions are forwardly inclined as shown in FIG. 16.

Figure 17:
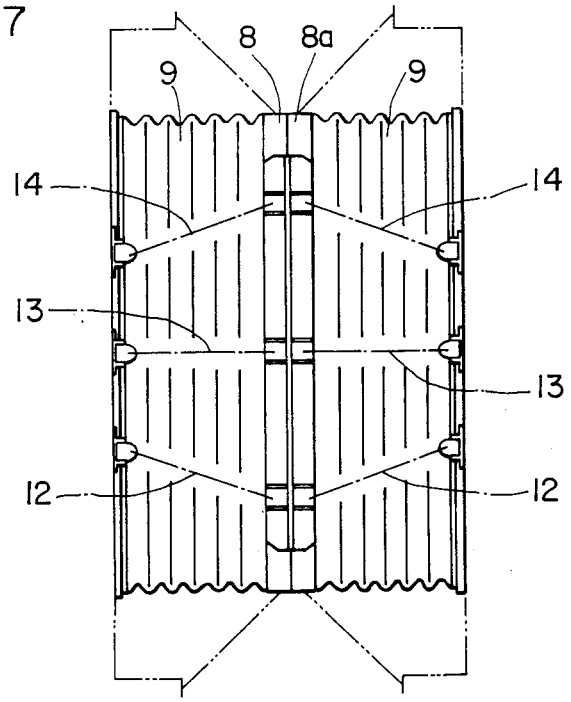
FIG. 17 is a plan view showing a transient coupled state of the hood structures.
Figure 18:
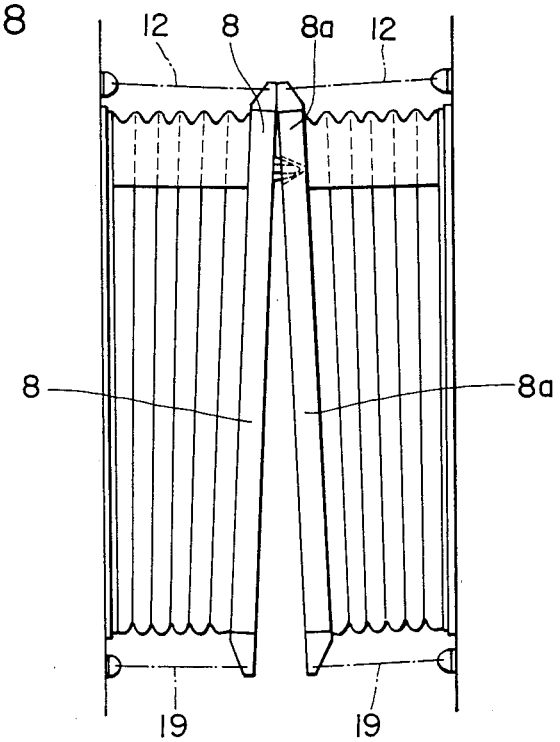
FIG. 18 is a side elevational view showing the transient coupled state of the hood structures.
Figure 19:
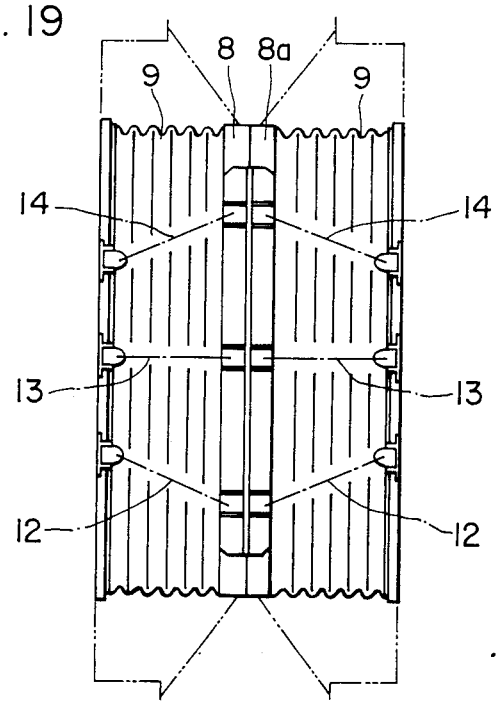
FIG. 19 is a plan view showing a completely coupled state of the hood structures.
Figure 20:
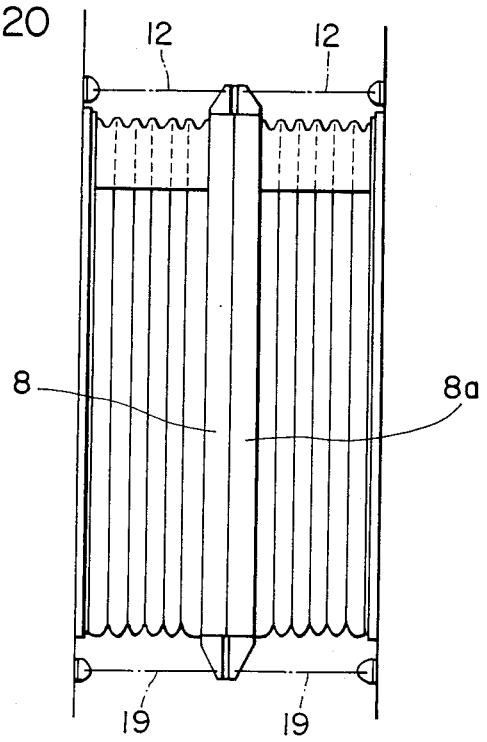
FIG. 20 is a side elevational view showing the completely coupled state of the hood structures.

When the two vehicles are made to approach each other for coupling the vehicles, the two free side metal frame 8 and 8*a* are automatically guided so that their upper portions are held in contact with each other, since the two free side metal frames 8 and 8*a* and the couplers 5 and 6 are urged together toward the centerline by the convergently arranged hood pressers 12, 14, 19 and 20 and the positioning projections 24 are introduced into the positioning holes 25, as shown in FIGS. 17 and 18. When the vehicles are made to further approach each other, the upper portions of the free side metal frame 8 and 8*a* are pressed toward the opening portions of the vehicles against the spring reaction of the upper hood pressers 12, 13 and 14, so that the hood structures 3 and 4 are contracted. At the same time, the positioning projections 24 are fully inserted into the positioning holes 25 to carry out the centering of the metal frames, and the centering of the couplers 5 and 6 causes the two release side metal frames 8 and 8*a* to be automatically centered and connected to each other. At this time, the pins 26 extending from the free side metal frames 8 and 8*a* are loosely engaged with the pin receivers 28 so that the lower portions of the free side metal frames 8 and 8*a* are pressed against the spring reaction of the hood pressers 19 and 20 to each other. Upon the completion of the coupling, the two hood structures 3 and 4 are prevented from sliding and shifting relative to each other in the right and left direction of the vehicles by the upper engagement between the positioning projections 24 and the positioning holes 25 and the lower engagement of the pins 26 and the pin receivers 28. Also, in the case where the hood structures 3 and 4 are vibrated in the right and left direction, the hood structures 3 and 4 are forced to return back to the central position by the convergently arranged hood pressers 12, 14, 19 and 20.

With respect to the vibration of the vehicles in the back and forth direction, the mutual pressure of the hood pressers withstands the vibration while keeping the coupled state of the hood structures 3 and 4.

Even though the vehicles would be shifted relative to each other due to various running motions such as rolling, pitching and yawing not only on the straight rails but also curve rails, the hood structures 3 and 4 follows the various motions in a flexible integral manner to always keep the connected state without separation. It is, therefore, unnecessary to couple the two free side metal frames 8 and 8*a* of the hood structures 3 and 4 by inserting pins or by means of fastening members or the like. Since the seal members 23 and 23 of the release side metal frames 8 and 8*a* are held in intimate contact with each other by such coupling, the atmosphere or rain drops are completely prevented from entering into the interior to keep a good condition even for running on the commercial line or work shop line.

Incidentally, in the case where the vehicles are connected to each other on the curved rails, the distal ends of the positioning projections 24 provided in the free side metal frames 8 and 8*a* are engaged with the tapered distal ends of the positioning holes 25, and by the subsequent approach the positioning projections 24 and guided to the deep central portions of the positioning holes 25 to thereby carry out the centering of the couplers 5 and 6, thus completing the coupling operation. Therefore, also in this case, the automatic and positive coupling may be ensured.

When the couplers 5 and 6 are separated to release the vehicles which have been held in the coupled state, the hood structures 3 and 4 are separated in the order opposite to that described above.

Although the convergently arranged hood pressers 12, 14, 19 and 20 are directed to the vehicle as described above, it is possible to arrange these pressers in a convergent manner toward the free side metal frame. Furthermore, although, in the foregoing embodiment, the positioning of the free side metal frames on the lower side is performed by the engagement between the pins 26 and the pin receivers 28 on the coupler 5 side, that positioning may be performed by providing members similar to the positioning projections 24 and the positioning holes 25 formed on the upper side, instead of the pins 26 and the pin receivers 28.

We claim:

1. A gangway construction for connecting vehicles comprising: divided hood structures, each of which has a first end and a second end, the first ends of the respective hood structures being fixed to the vehicles leaving the second ends thereof free and disposed to face each other; means for resiliently suspending the second ends of the hood structures from the vehicles, a plurality of hood pressers provided between the vehicles and at least upper sides of metal frames on the second ends of the hood structures for urging said hood structures into extended positions, said plurality of hood pressers being coupled to the vehicles and said metal frames by universal joint means for allowing universal movement of said metal frames with respect to the vehicles, said plurality of hood pressers being arranged in a horizontal plane to converge from their respective joint means on the metal frame inwardly toward a centerline of the vehicle; and positioning members for guiding and engaging each other upon mutual approach of said members to effect a centering action on the second ends of the hood structures, said positioning members being provided in said metal frames on the second ends of the hood structures.

2. The gangway construction according to claim 1, said positioning members comprising a positioning projection and a conical positioning hole, wherein one of said metal frames of said hood structures has said positioning projection and the other metal frame has said conical positioning hole engageable with said projection, said projection and hole being located at confronting positions.

3. The gangway construction according to claim 1 in which said hood pressers have predetermined pressing force and stroke so that said metal frames on the second ends of the hood structures touch and are pressed against each other without any tightening fixtures when the vehicles are coupled together.

4. The gangway construction according to claim 1 in which said hood pressers maintain said hood structures in symmetrically-arranged positions relative to the vehicles when the vehicles are uncoupled.

5. The gangway construction according to claim 1 in which each of said hood pressers includes a piston and cylinder assembly around which a coil spring is provided, said spring having an extension direction and said assembly supplying a pressing force in said spring's extension direction.

6. The gangway construction according to claim 1 in which said hood pressers and said positioning members are provided on at least the upper sides of said metal frames on the second ends of the hood structures.

7. A gangway construction for connecting vehicles comprising: divided hood structures, each of which has a first end and a second end, the first ends of the respective hood structures being fixed to the vehicles leaving the second ends thereof free and disposed to face each other; means for resiliently suspending the second ends of the hood structures from the vehicles, a plurality of hood pressers provided between the vehicles and at least upper sides of metal frames on the second ends of the hood structures for urging said hood structures into extended positions, said plurality of hood pressers being coupled to the vehicles and said metal frames by universal joint means for allowing universal movement of said metal frames with respect to the vehicles, said plurality of hood pressers being arranged in a horizontal plane and including a central hood presser arranged in alignment with a centerline of the vehicle and a pair of side hood pressers inclined in opposite directions with respect to the centerline and arranged in a convergent relation toward the centerline of the vehicle; and positioning members for guiding and engaging each other upon mutual approach of said members to effect a centering action on the second ends of the hood structures, said positioning members being provided in said metal frames on the second ends of the hood structures.

* * * * *